US007461438B2

(12) United States Patent
Sommer et al.

(10) Patent No.: US 7,461,438 B2
(45) Date of Patent: Dec. 9, 2008

(54) APPARATUS AND METHOD FOR APPLYING FINISHING AGENTS ONTO A NONWOVEN WEB

(75) Inventors: Sebastian Sommer, Troisdorf (DE); Jens Guedden, Troisdorf (DE); Thomas Fett, Wesseling (DE)

(73) Assignee: Reifenhaeuser GmbH & Co. Maschinenfabrik, Troisdorf (DE)

( * ) Notice: Subject to any disclaimer, the term of this patent is extended or adjusted under 35 U.S.C. 154(b) by 541 days.

(21) Appl. No.: 11/068,850

(22) Filed: Mar. 2, 2005

(65) Prior Publication Data

US 2005/0196538 A1 Sep. 8, 2005

(30) Foreign Application Priority Data

Mar. 3, 2004 (DE) ..... 10 2004 010 245
Feb. 18, 2005 (EP) ..... 05003500

(51) Int. Cl.
*B05C 1/04* (2006.01)

(52) U.S. Cl. ..... 28/167; 28/169; 118/211

(58) Field of Classification Search ..... 28/167, 28/104, 105, 169; 68/202, 200, 203; 118/207, 118/419, 209, 211–213, 230–232, 235, 244, 118/245, 301, 264, 266, 325, 319
See application file for complete search history.

(56) References Cited

U.S. PATENT DOCUMENTS 2,862,251 A * 12/1958 Kalwaites ..... 264/119
3,113,349 A * 12/1963 Nottebohm et al. ..... 264/119
3,274,018 A * 9/1966 Russell et al. ..... 427/275
3,393,661 A * 7/1968 Sharp ..... 118/411
3,735,730 A * 5/1973 Mitter ..... 118/205
3,919,973 A * 11/1975 Zimmer ..... 118/406
4,016,317 A * 4/1977 Kalwaites ..... 428/88
4,332,454 A * 6/1982 Hensel et al. ..... 396/611
4,672,705 A * 6/1987 Bors et al. ..... 8/151
4,775,873 A * 10/1988 Blackman et al. ..... 396/618
5,158,806 A 10/1992 Unger ..... 427/359
5,569,326 A * 10/1996 Ruhl ..... 118/205
5,798,068 A * 8/1998 Vlug ..... 264/171.13
5,965,220 A * 10/1999 Schopping ..... 427/598
6,530,246 B1 * 3/2003 Hausmann ..... 68/200
6,758,906 B2 * 7/2004 Maiwald et al. ..... 118/315
6,957,474 B2 * 10/2005 Fleissner ..... 28/104
2003/0217448 A1 * 11/2003 Andersen ..... 28/104
2005/0172890 A1 * 8/2005 Ghelli et al. ..... 118/200
2005/0196538 A1 9/2005 Sommer ..... 427/372.2

FOREIGN PATENT DOCUMENTS

DE 690 14 983 T2 5/1995
EP 0 397 506 A2 11/1990
WO WO 99/33623 7/1999

* cited by examiner

*Primary Examiner*—Amy B Vanatta
(74) *Attorney, Agent, or Firm*—Andrew Wilford

(57) ABSTRACT

An apparatus for applying finishing agents onto a nonwoven web, wherein there is provided a device for pre-bonding of the nonwoven web. There is provided at least one guide surface, over which the pre-bonded nonwoven web is guided. Outlet openings for the finishing agent are provided in the guide surface, so that finishing agent can be applied onto the nonwoven web being guided over the guide surface.

9 Claims, 4 Drawing Sheets

APPARATUS AND METHOD FOR APPLYING FINISHING AGENTS ONTO A NONWOVEN WEB

FIELD OF THE INVENTION

The invention relates to an apparatus for applying finishing agents to a nonwoven web. The nonwoven web may be made of filaments or fibers of thermoplastic plastic, especially of polypropylene, polyethylene, polyester or polyamide. These filaments can be one-component filaments or even two-component or multi-component filaments. The nonwoven web may also be made of natural raw materials, such as cellulose fibers.

DESCRIPTION OF THE RELATED ART

It is known in principle how to apply finishing agents to nonwoven webs composed of filaments of thermoplastic plastic. In known procedures it is usually necessary to use a very painstaking method for drying the nonwoven web being treated with the finishing agents. Moreover, the precision with which the finishing agents are proportioned in the known methods is not sufficient. The uniformity of distribution of finishing agents applied using known methods often does not meet the requirements. It is also known how to apply finishing agents via a roll to a nonwoven web by the slop-pad method. This procedure also suffers from the disadvantages described hereinabove. The disadvantages prove to be particularly problematic for pre-bonded or already bonded nonwoven webs. If the nonwoven webs were already pre-bonded in a calender or, for example, were mechanically needled, problems often occur in the application of finishing agents to these bonded nonwoven webs. The precision with which the finishing agents are proportioned and especially the uniformity of distribution of the applied finishing agents frequently also leaves much to be desired in these cases.

SUMMARY OF THE INVENTION

Accordingly, the technical solution underlying the invention is to provide an apparatus of the type mentioned hereinabove with which the finishing agents can be proportioned simply and in a functionally reliable manner and can be applied precisely and with very uniform distribution on a pre-bonded or bonded nonwoven web. To solve the technical problem, the invention teaches an apparatus for applying finishing agents to a nonwoven web and having a device for pre-bonding the nonwoven web, at least one guide surface over which the pre-bonded nonwoven web is guided, and outlet openings for the finishing agent in the guide surface, so that the finishing agent can be applied to the nonwoven web guided over the guide surface.

BRIEF DESCRIPTION OF THE DRAWINGS

The invention will be explained in more detail hereinafter in the figures which illustrate merely one practical example that is not intended to limit the claimed invention and in which, in schematic diagrams:

DETAILED DESCRIPTION OF THE INVENTION

Figure 1:
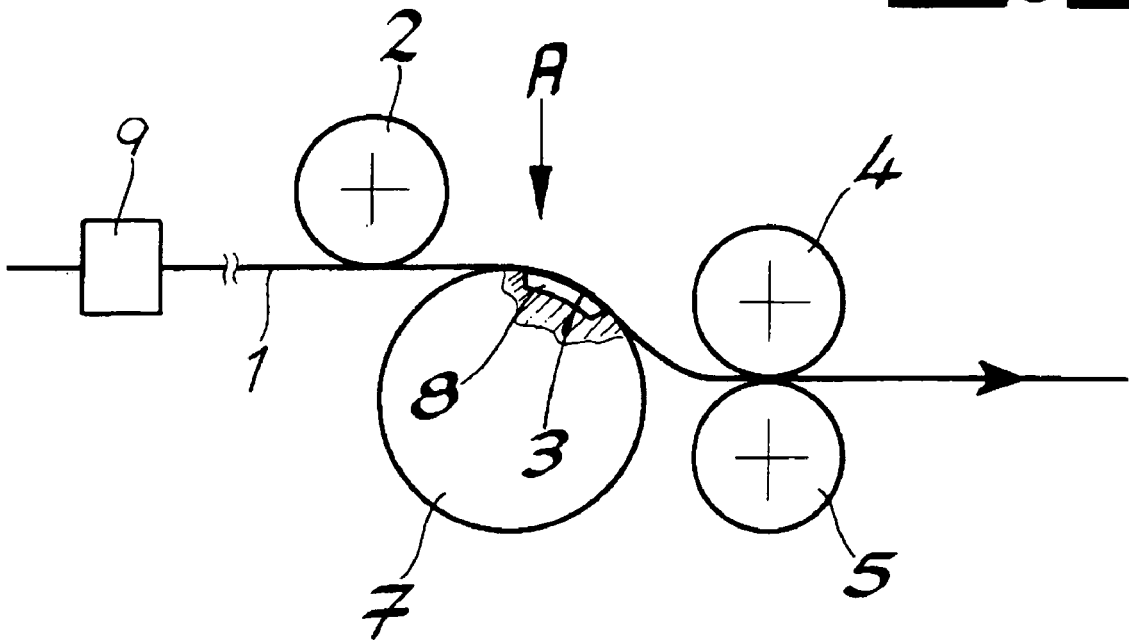
FIG. 1 shows a side view of an inventive apparatus partly in section.

Finishing agents include substances with which the surface properties of the fibers of filaments can be modified. Finishing agents make it possible to change the wettability properties of the fibers, e.g., by modifying the fibers to make them hydrophilic or hydrophobic or oleophilic or oleophobic. Furthermore, it is possible to modify the conductivity of the fibers with finishing agents, especially by using antistatic agents as finishing agents. Even the fire-resisting properties of the fibers can be modified by applying finishing agents. Within the scope of the invention, the finishing agents may be applied to the nonwoven web as a liquid system, especially as a liquid solution or liquid mixture or as an emulsion. In particular, multi-component systems are may be used for this purpose. The surface-modifying substances contained in the liquid solutions, liquid mixtures or emulsions are frequently referred to as finishing agents in the trade literature. The term finishing agent as used herein may refer to means the entire liquid solution or entire liquid mixture or emulsion being applied to the nonwoven web. The finishing agents used according to the invention are preferably liquid solutions containing at least one polar solvent or liquid mixtures containing at least one polar solvent or emulsions containing at least one polar solvent. The finishing agents may also be used without solvents. Within the scope of the invention, melts of substances that are solids at 30° C., especially polymer melts, are not interpreted as finishing agents. Within the scope of the invention, a preferred embodiment of the application of finishing agents is the application of surfactants. In this connection, it is within the scope of the invention for ionic, or in other words cationic and/or anionic and/or nonionic surfactants to be used. According to one embodiment, amphoteric surfactants can also be used for the finishing agent. In particular, the hydrophilic properties of the nonwoven web can be modified with surfactants. Within the scope of the invention, fatty acid amides or fluorocarbons, for example, can be used in the finishing agents to achieve hydrophobic modification of the nonwoven web. In one embodiment of the invention, the term pre-bonding means that the nonwoven web is first pre-bonded and in a subsequent process step is finish-bonded. However, the use of the term pre-bonded does not necessarily mean that further bonding or finish-bonding must follow. Thus it is also within the scope of the invention for pre-bonding of the nonwoven web to comprise a single bonding step and thus for practical purposes the finish-bonding of the nonwoven web. According to a particularly preferred embodiment of the invention, the device for pre-bonding is a calender, especially a roller-type calender. Thus the nonwoven web is passed through a calender or roller-type calender prior to application of the finishing agent. According to another embodiment of the invention, the device for pre-bonding can also be a device for hot-air bonding. Furthermore, it is within the scope of the invention for the device for pre-bonding to be a means for water-jet bonding or for hydrodynamic needling (e.g., a water-jet bonding device or a hydrodynamic needling device). Moreover, it is also possible to use a means for mechanical needling of the nonwoven web as the device for pre-bonding (e.g., a mechanical needling device). According to a particularly preferred embodiment of the invention, only one of the aforesaid devices is used for pre-bonding. In principle, however, it is also within the scope of the invention to combine a plurality of these devices for pre-bonding with one another. It is within the scope of the invention for the finishing agent to be fed to the nonwoven web via a transverse duct, which expediently extends across the travel direction of the nonwoven web or substantially across the travel direction of the nonwoven web. To the transverse duct there is connected at least one feed duct, preferably a plurality of feed ducts, which feed the finishing agent from the transverse duct to the application zone of the guide surface. The feed ducts normally have smaller diameter than the transverse duct, and to this extent the finishing agent flowing through is subjected to a larger pressure loss than in the transverse duct. According to one embodiment of the invention, the transverse duct is designed with a cross section that varies over the length or over the application width, so that the sum of the pressure loss in the transverse duct and the pressure loss in the feed duct or feed ducts to each outlet position is constant over the application width. It is within the scope of the invention for the finishing agent to be delivered by means of at least one pump. According to one embodiment, there is provided a plurality of pumps, which supply zones disposed next to one another over the application width. According to another embodiment, a pump with distributors disposed downstream can also be used, the distributors uniformly distribute the volume flow of the finishing agent. It is also within the scope of the invention for a pump to feed the transverse duct at a plurality of points over the application width, the connections between the pump and the respective feed point on the transverse duct being designed for similar or identical pressure losses. According to a preferred embodiment of the invention, the finishing agent is applied from underneath to the nonwoven web being guided over the guide surface. In principle, however, it is also within the scope of the invention for the finishing agent to be applied from above or from the side to the nonwoven web being guided over the guide surface. One embodiment of the invention is characterized in that at least part of the guide surface is disposed with a descending slope in the travel direction of the nonwoven web. According to a very preferred embodiment, which has quite particular importance in the scope of the invention, the guide surface is designed with a curvature in the travel direction of the nonwoven web. Thus the nonwoven web is guided over a curved or arched guide surface. In a preferred embodiment this guide surface can be curved continuously. In principle, however, it is also within the scope of the invention for straight or non-curved portions to be formed together with curved portions in the guide surface. As regards the curvature of the guide surface, various radii of curvature are possible. A preferred embodiment of the invention is characterized in that the guide surface has the shape of part of a cylindrical shell and, for example, can be part of a cylindrical roll or part of a cylindrical tube. According to one embodiment, this surface can be a roll that does not rotate during operation or a tube that does not rotate during operation. According to another embodiment, however, the guide surface can also be part of a roll that rotates during operation or part of a tube that rotates during operation. In particular, the roll or the tube can then be provided with a porous wall. It is within the scope of the invention for at least one row of outlet openings to be provided in the guide surface across the travel direction of the nonwoven web. According to one embodiment, this row of outlet openings can extend over the entire width of the guide surface or over the entire width of the nonwoven web being guided over the guide surface. According to another embodiment, however, the row of outlet openings can extend over only part of the width of the guide surface or over only part of the width of the nonwoven web being guided over the guide surface. In this way it is possible, for example, to apply the finishing agent in stripes, and peripheral zones can be left free of application on the nonwoven web. It is also within the scope of the invention for zones free of outlet openings to be present in a row of outlet openings disposed across the travel direction of the nonwoven web. Thereby it is possible to produce, on the nonwoven web, stripes which are free of application or in which no finishing agent is applied or introduced. In principle, a row of outlet openings can be oriented in any desired direction in the guide surface, or in other words at any desired angle relative to the travel direction of the nonwoven web. It is within the scope of the invention for a plurality of adjacent rows of outlet openings to be provided in the guide surface. According to one embodiment of the invention, the openings of adjacent rows are disposed in a manner offset from one another. The outlet openings are expediently provided in the guide surface with the criterion that the most uniform possible distribution of the finishing agent is achieved in the application zones of the nonwoven web. One embodiment of the invention is characterized in that at least some of the outlet openings can be closed or reopened as needed. In this way also it is possible in relatively simple manner to adjust regions or zones in which finishing agent will or will not be applied on the nonwoven web. For closing the outlet openings there are provided closing elements, which preferably are disposed on the underside of the guide surface facing away from the nonwoven web. According to one embodiment of the invention, a plurality of outlet openings can be closed with a single closing element. However, it is also possible to provide one closing element for each outlet opening. One preferred embodiment is characterized in that the opening width can be adjusted for at least some of the outlet openings. According to this embodiment, therefore, it is possible to adjust the opening width or the opening diameter of outlet openings, preferably of all outlet openings. It is within the scope of the invention for the opening width of different outlet openings to be adjustable independently of one another. By adjusting the opening width or the opening diameter of the outlet openings, it is possible to adjust the quantity of finishing agent that passes through the outlet openings per unit of time and is applied on the nonwoven web. In principle, the outlet openings formed in the guide surface can have different cross sections. For example, they can be circular or else oval bores or, for example, slits. The guide surface can also contain permeable sintered elements, through which the finishing agent can penetrate. It is further within the scope of the invention for the outlet openings to be formed as single-cell or multiple-cell units. According to a preferred embodiment of the invention, the guide surface or a part of the guide surface provided with outlet openings can be displaced relative to the nonwoven web. In particular, it can be adjusted vertically, perpendicular to the travel direction of the nonwoven web. Because of this movement capability, the contact between the guide surface and the nonwoven web can be broken. By virtue of the displacement of the guide surface, especially in the case of vertical adjustment of the guide surface, it is possible in the case of a curved guide surface to adjust the area of contact of the guide surface with the nonwoven web or the wrap angle with which the nonwoven web is wound around the curved guide surface. In principle, it is within the scope of the invention for the area of contact of the guide surface with the nonwoven web to be adjustable. Expediently, the engaging position of the nonwoven web on the guide surface is adjustable and/or the disengaging position at which the nonwoven web leaves the guide surface is adjustable. The engaging or disengaging position of the nonwoven web can also be influenced, for example, by displacing neighboring deflecting rolls for the nonwoven web. If the guide surface is removed from contact with the nonwoven web because of its movability, it is possible according to a preferred embodiment of the invention to adjust a rinsing position for the guide surface, in which position the guide surface can be rinsed or cleaned. According to a very preferred embodiment, which has quite particular importance in the scope of the invention, the guide surface has a breakaway edge in the disengaging zone of the nonwoven web (or at the disengaging position of the nonwoven web). The terms disengaging zone or disengaging position are used herein to mean the point at which the nonwoven web leaves the guide surface or loses contact with the guide surface. At the breakaway edge, the course of the guide surface deviates, preferably distinctly, from the travel direction of the nonwoven web, and to this extent there is formed an edge or so to speak a sharp edge, at which the nonwoven web leaves the guide surface. Any curvature of the guide surface expediently ends abruptly here. The part of the guide surface that is in contact with the nonwoven web shortly before the breakaway edge and that part of the guide surface that is no longer in contact with the nonwoven web shortly after the breakaway edge expediently form an angle of smaller than 100° and preferably an angle of 90° or approximately 90° or smaller than 90°. Such a breakaway edge has proved particularly useful within the scope of the invention. This breakaway edge prevents the situation in which a residue of the finishing agent dries on the guide surface after the disengaging position or after the disengaging zone of the nonwoven web. Such a situation could lead to constraints or irregularities in continuous operation. By means of the breakaway edge, entrained finishing agent remains reliably separated from the guide surface and from the nonwoven web. According to a very preferred embodiment of the invention, the guide surface can be heated. For this purpose at least one heating element is provided on the guide surface. Preferably a plurality of heating elements is disposed in distributed manner over the guide surface. The heating element or the heating elements are expediently disposed on the underside of the guide surface facing away from the nonwoven web. By heating the guide surface, the viscosity of the finishing agent can be adjusted in a simple and functionally reliable manner. Thereby it is possible to ensure better wettability of the nonwoven web, especially even in the case of highly concentrated finishing agents and finishing agents that have relatively high viscosity or high viscosity at room temperature. In principle, the finishing agent can also be heated on its way to the guide surface, or in other words in the transverse duct or in the feed duct. The invention also includes a method for applying finishing agents to a nonwoven web, wherein the nonwoven web is first pre-bonded and wherein the nonwoven web is then guided over at least one guide surface, on which finishing agent is applied to the nonwoven web through outlet openings in the guide surface. It is within the scope of the invention for a solution containing at least one polar solvent and/or a liquid mixture containing at least one polar liquid and/or an emulsion containing at least one polar liquid to be applied as finishing agent. For this purpose, particularly water or an alcohol is used as the polar solvent or as the polar liquid. According to a preferred embodiment of the invention, this finishing agent is an aqueous solution or an aqueous mixture or an aqueous emulsion. Other polar liquids such as organic solvents including alcohols may be used alone or together with water. As already explained hereinabove, the nonwoven web is pre-bonded in a pre-bonding device before application of the finishing agent. Preferably the nonwoven web is calendered before it is guided over the guide surface. However, it is also within the scope of the invention for the nonwoven web to be pre-bonded in any other way, as already described hereinabove. According to a particularly preferred embodiment of the inventive method, the guide surface is heated to a temperature between 30° C. and a maximum temperature, which maximum temperature lies 1 to 5° C. below the boiling point of the most volatile component of the finishing agent which is present in a proportion of at least 10 wt % in the finishing agent. The temperature may be for example 40° C., 50° C., 60° C., 70° C., 80° C., 90° C., 100° C., or higher, or any value between the stated values. The most volatile component means that component of the finishing agent that is present in a proportion of at least 10 wt % in the finishing agent while having the lowest boiling point compared with other components present in a proportion of at least 10 wt % in the finishing agent. Preferably the highest temperature to which the guide surface can be heated lies 3° C. below the boiling point of the said most volatile component. It is within the scope of the invention for at least part of the guide surface to be heated in the described manner. Expediently, the guide surface or at least part of the guide surface is heated to at least 30° C., preferably to at least 40° C. and very preferably to at least 50° C. According to a very preferred embodiment of the inventive method, the finishing agent is used in concentrated or slightly diluted form. In principle, it is also within the scope of the invention for a pure surface-property-modifying substance to be used in undiluted form or applied as finishing agent to the nonwoven web. On the other hand, it is also possible to work with more dilute solutions, mixtures or emulsions. Within a preferred embodiment the finishing agent is fed or emerges from the outlet openings of the guide surface continuously or uniformly and without pulsations. This embodiment has proven particularly effective. The invention is based on the knowledge that, by virtue of the inventive apparatus or by virtue of the inventive method, finishing agents can be proportioned to the nonwoven web very simply and in functionally reliable manner. In this connection, it must be emphasized in particular that the finishing agents can also be applied selectively and uniformly to a pre-bonded nonwoven web, so that the pre-bonded nonwoven web can be wetted homogeneously by the finishing agent. In the procedures known from the prior art for application of finishing agents, uniform and homogeneous application of finishing agents to pre-bonded nonwoven webs is often problematic. However, the invention also has further advantages. In particular, recirculation of spent finishing agent is in principle unnecessary, because the finishing agent can be applied selectively and precisely in the needed quantity. Furthermore, the inventive apparatus is characterized by relatively simple equipment. Because of the adjustment capabilities for the guide surface or for the outlet openings, the area of contact between finishing agent and nonwoven web can be adjusted flexibly, in order, for example, to vary the penetration time and/or distribution time. Zones or stripes in which the finishing agent is or is not applied to the nonwoven web are selected in simple and functionally reliable manner. The delivery volume or the delivery capacity of the pump or pumps directly determines the quantity of finishing agent that can be applied to the nonwoven web. By adjustment of the delivery volume of the pumps, therefore, it is possible to precisely proportion the quantity of finishing agent being applied. In this connection it is also within the scope of the invention for the delivery quantity of the pump to be controllable by a process control system for the overall apparatus or for the overall installation. In particular, the application of concentrated finishing agents, or in other words of slightly diluted finishing agents, as is preferred within the scope of the invention, is associated with quite particular advantages. On the one hand, harmful foaming during application can be avoided and, on the other hand, bacterial contamination or fungal contamination of the nonwoven web can be avoided, thus making the use of cleaning agents or disinfectants unnecessary. Because of the use of concentrated or slightly diluted finishing agents, it is also not necessary to perform painstaking drying of the nonwoven web. The migration effect can be reduced during application of concentrated or slightly diluted finishing agents. Thereby the course of the boundary between, for example, hydrophobic untreated nonwoven-web zones and hydrophilic nonwoven-web zones to be treated, can be made sharper and straighter.

Figure 2:
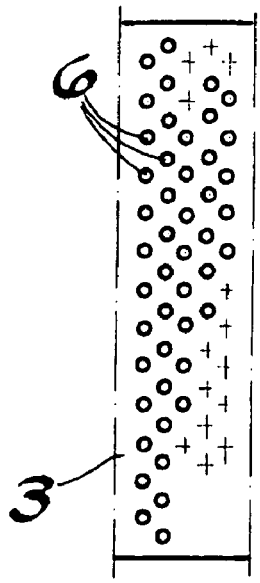
FIG. 2 shows a part of the object according to FIG. 1 in top view from the direction of arrow A of FIG. 1.
Figure 3:
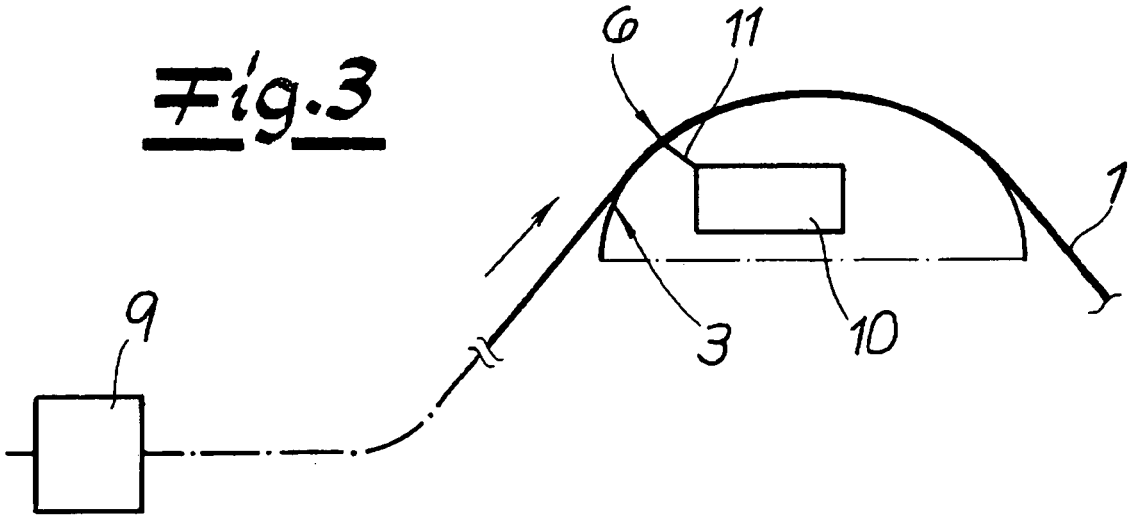
FIG. 3 shows a detail of the object according to FIG. 1 in a second embodiment.
Figure 4:
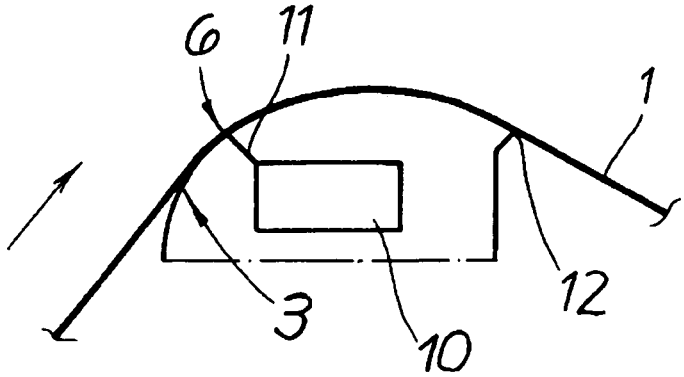
FIG. 4 shows the object according to FIG. 3 in a third embodiment.
Figure 5:
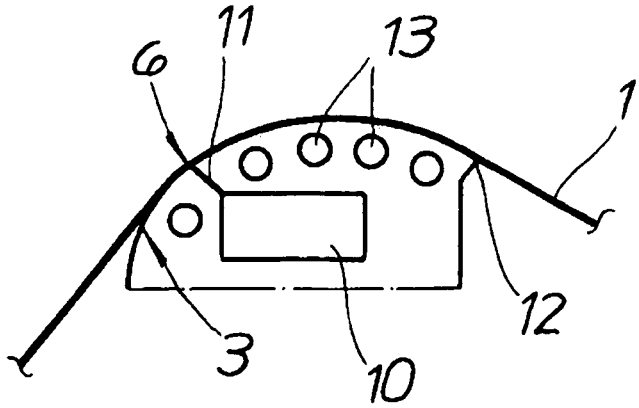
FIG. 5 shows the object according to FIG. 3 in a fourth embodiment.
Figure 6:
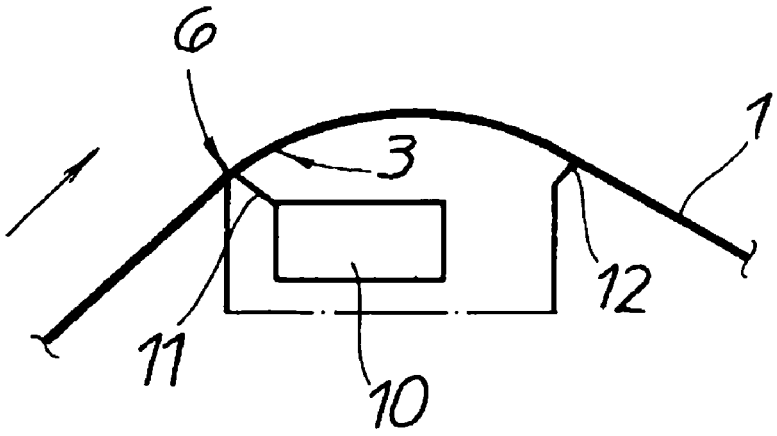
FIG. 6 shows the object according to FIG. 3 in a fifth embodiment.
Figure 7:
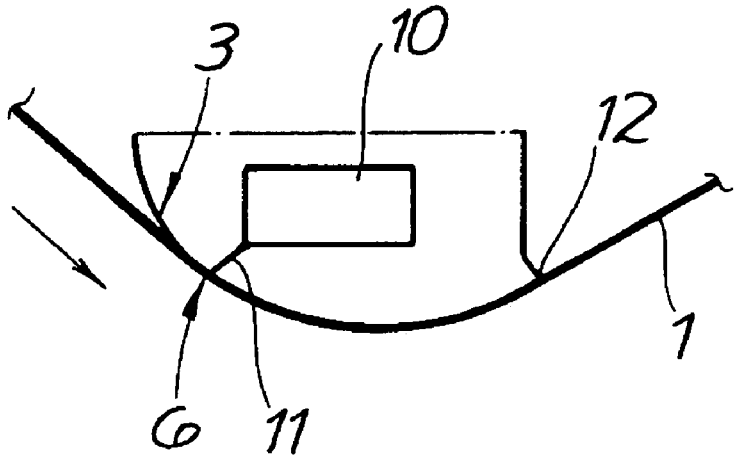
FIG. 7 shows a variant on the system of FIG. 3.
Figure 8:
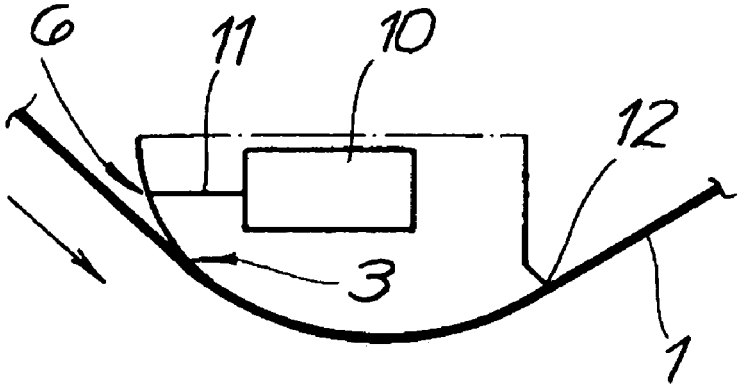
FIG. 8 shows another variant on the system of FIG. 3.
Figure 9:
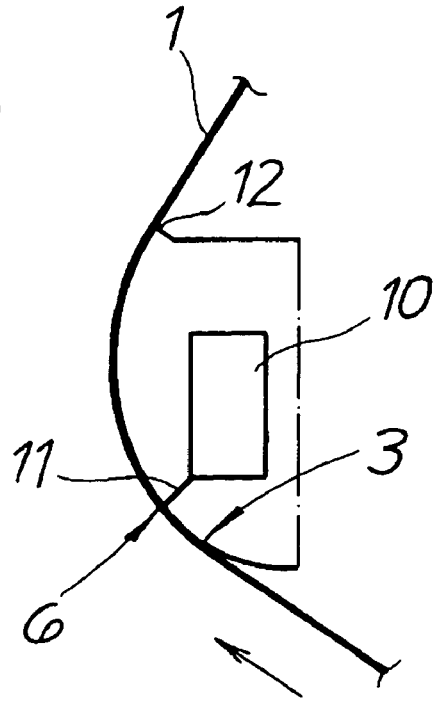
FIG. 9 shows yet another variant on the system of FIG. 3.
Figure 10:
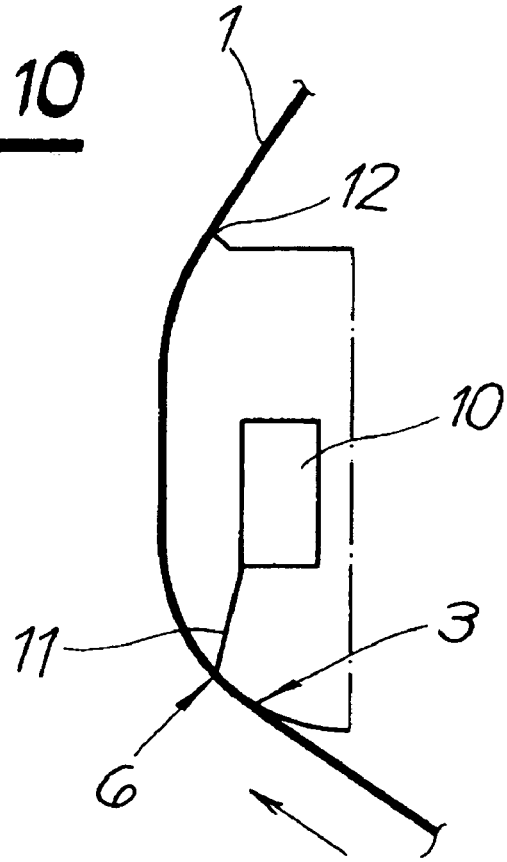
FIG. 10 shows the system of FIG. 9 in somewhat modified form.

The figures show an apparatus for application of finishing agents to a nonwoven web 1, which is being delivered in the direction of the arrow. In FIG. 1 it is evident that the nonwoven web is first guided through a device 9 for pre-bonding the nonwoven web. This pre-bonding device 9 can preferably be a roller-type calender, as is the case in the practical example. In the practical example according to FIG. 1, this pre-bonded nonwoven web 1 is then passed under a feed roll 2, which preferably is vertically adjustable. Thereupon the nonwoven web 1 is guided over a guide surface 3 and is then passed between takeoff rolls 4, 5. In the practical example according to FIG. 1, outlet openings 6 (shown in FIG. 2) for the finishing agent are provided on the guide surface 3, with the criterion that finishing agent is applied from underneath to the nonwoven web 1 being guided over the guide surface 3. Preferably, and in the practical example according to FIG. 1, the guide surface 3 forms a descending slope in the travel direction of nonwoven web 1. In other words, guide surface 3 has a downward gradient in the travel direction of nonwoven web 1. According to one embodiment, and in the practical example, guide surface 3 has the shape of part of a cylindrical surface, and in the practical example it is part of a cylindrical roll 7. In the embodiment according to FIG. 1, it is a roll 7 that does not rotate during operation. It is evident in FIG. 2 in particular that a plurality of adjacent rows of outlet openings 6 is disposed in guide surface 3 each extending across the travel direction of nonwoven web 1. Preferably, and in the practical example, the adjacent rows are disposed parallel to one another, and outlet openings 6 of adjacent rows are staggered relative to one another in this case. Very uniform distribution of the liquid substance on nonwoven web 1 or in nonwoven web 1 can be achieved by such an arrangement of outlet openings 6. In the practical example according to FIG. 1, a distributor chamber 8 for the finishing agent is provided underneath guide surface 3. Distributor chamber 8 is connected to at least one pump, which is not illustrated, for delivering the finishing agent. The finishing agent then exits distributor chamber 8 via outlet openings 6. In this case the method is preferably operated in such a way that the finishing agent exits outlet openings 6 without pulsations. Further embodiments of the inventive apparatus are illustrated schematically in FIGS. 3 to 10. For those cases it must be kept in mind that each of the embodiments is equipped in principle with a device 9 for pre-bonding nonwoven web 1, even though, for simplicity, this device 9 has been indicated only in FIG. 3. All apparatuses of FIGS. 3 to 10 have a curved guide surface 3, in which outlet openings 6 for the finishing agent are disposed in distributed manner. FIGS. 3 to 10 all show a transverse passage 10, which extends across the travel direction of nonwoven web 1 and in which finishing agent is delivered. Expediently, at least one pump, which is not illustrated, is connected to transverse duct 10 for delivering the finishing agent. Also provided in FIGS. 3 to 10 is a feed duct 11, which is connected to transverse duct 10 and which delivers finishing agent from transverse duct 10 to guide surface 3 or to outlet openings 6 of guide surface 3. This feed duct 11 has been indicated very schematically in the figures. Transverse duct 10 usually has a larger cross section or larger diameter than a feed duct 11. A feed duct 11, which distributes the finishing agent to a plurality of outlet openings 6, can be connected to a distributor chamber 8 disposed underneath guide surface 3. In principle, however, a feed duct 11 can also be connected to an individual outlet opening 6. It is self-evident that a plurality of feed ducts 11 can be provided and, in fact, not only can they be disposed successively in the travel direction of nonwoven web 1, but also they can be disposed side-by-side across the travel direction of nonwoven web 1. In the practical example according to FIGS. 3 to 10, the point at which feed duct 11 illustrated therein meets guide surface 3 is intended to represent the place at which there is disposed the first outlet openings 6 or the first row of outlet openings 6 that nonwoven web 1 encounters. In the practical example according to FIG. 3, guide surface 3 has continuously curved structure over the entire zone in which it has contact with nonwoven web 1. Thus nonwoven web 1 first travels over an ascending portion and then over a descending portion of guide surface 3. Curved surface 3 of FIG. 3 corresponds to part of a cylindrical shell. In this case, moreover, outlet openings 6 for the finishing agent are disposed after the engaging zone or after the engaging position of nonwoven web 1. The aforesaid arrangement of outlet openings 6 is also implemented in the practical example according to FIG. 4. In this case, in a very preferred embodiment of the invention, guide surface 3 has a breakaway edge 12 in the disengaging zone of nonwoven web 1 or in the disengaging position of nonwoven web 1. This breakaway edge 12 advantageously ensures that the finishing agent not absorbed by the nonwoven web is reliably kept separate from nonwoven web 1 after the disengaging zone of nonwoven web 1. The embodiment illustrated in FIG. 5 corresponds in principle to the embodiment according to FIG. 4. In this case, however, heating elements 13, with which guide surface 3 can be heated, are provided underneath guide surface 3. In this way the viscosity of the finishing agent to be applied can be adjusted very precisely. In the practical example according to FIG. 6, nonwoven web 1 is fed in its engaging zone directly or linearly to outlet openings 6. In other words, nonwoven web 1 is not guided first (in contrast to FIGS. 3 to 5) over a curved zone of guide surface 3 before the outlet openings. Thereby dry friction of nonwoven web 1 on the guide surface before application of the finishing agent is avoided. Whereas the finishing agent in FIGS. 3 to 6 is applied to the nonwoven web from underneath through outlet openings 6 of guide surface 3, the finishing agent in the practical example according to FIG. 7 is applied from above to nonwoven web 1. FIG. 8 illustrates a similar embodiment, but in this case the finishing agent already exits outlet openings 6 of guide surface 3 before the engaging zone of nonwoven web 1. By virtue of gravity, the finishing agent in this case flows down to the engaging zone of nonwoven web 1, where it is absorbed by nonwoven web 1. In the practical example according to FIGS. 9 and 10, the finishing agent is applied to nonwoven web 1 sideways from outlet openings 6 of guide surface 3. Guide surface 3 in FIG. 9 is continuously curved. In contrast, in the practical example according to FIG.

10, there is provided a linear or planar portion of guide surface 3, which portion is bounded by two curved portions of guide surface 3. German application 102004010245 (US equivalent 2005/0196538) and European application 05003500.5, filed on Feb. 18, 2005 are each incorporated herein by reference in their entireties. Obviously, numerous modifications and variations of the present invention are possible in light of the above teachings. It is therefore to be understood that within the scope of the appended claims, the invention may be practiced otherwise than as specifically described herein.

The invention claimed is:

1. An apparatus for treating and applying finishing agents onto a nonwoven web, the apparatus comprising:

at least one device for pre-bonding the nonwoven web, at least one convexly arcuate guide surface, means for guiding the pre-bonded nonwoven web in an arcuate path in a travel direction over and in contact with the surface, the guide surface being formed along the path with an array of outlet openings and formed at a downstream end of the path with a sharp breakaway edge directed downstream in the travel direction, and means for supplying a finishing agent to the openings for applying the finishing agent onto the nonwoven web guided over the guide surface.

2. The apparatus according to claim 1 wherein the device for pre-bonding is a calender.

3. The apparatus according to claim 2, wherein the calender is a roller-type calender.

4. The apparatus according to claim 1 wherein the finishing agent is a liquid and the surface is directed upward to apply the finishing agent from underneath to the nonwoven web.

5. The apparatus according to claim 1 wherein the outlet openings are arrayed in at least one row extending transverse to the travel direction of the nonwoven web.

6. The apparatus according to claim 1, further comprising means for heating the guide surface and the finishing agent issuing from the openings.

7. The apparatus according to claim 1 wherein the openings open upward.

8. The apparatus according to claim 1 wherein the openings are distributed uniformly in the array in and transverse to the travel direction.

9. The apparatus according to claim 1 wherein the surface is stationary.

* * * * *